US006179252B1

(12) United States Patent
Roop et al.

(10) Patent No.: US 6,179,252 B1
(45) Date of Patent: Jan. 30, 2001

(54) INTELLIGENT RAIL CROSSING CONTROL SYSTEM AND TRAIN TRACKING SYSTEM

(75) Inventors: Stephen S. Roop, College Station; Leonard G. Ruback, Bryan, both of TX (US)

(73) Assignee: The Texas A&M University System, College Station, TX (US)

( * ) Notice: Under 35 U.S.C. 154(b), the term of this patent shall be extended for 0 days.

(21) Appl. No.: 09/118,524

(22) Filed: Jul. 17, 1998

(51) Int. Cl.[7] ..... B61L 29/00
(52) U.S. Cl. ..... 246/293; 246/122 R
(58) Field of Search ..... 246/111, 113, 246/114 R, 114 A, 122 R, 124, 125, 126, 127, 292, 293, 294, 295, 296; 340/902, 901, 903, 910, 917, 992, 993

(56) References Cited

U.S. PATENT DOCUMENTS

| | | | | |
|---|---|---|---|---|
| 4,073,453 | | 2/1978 | Thomas . | |
| 4,152,756 | | 5/1979 | Wrege et al. . | |
| 5,519,390 | | 5/1996 | Casini . | |
| 5,533,695 | * | 7/1996 | Heggestad et al. | 246/122 R |
| 5,554,982 | | 9/1996 | Shirkey et al. . | |
| 5,620,155 | | 4/1997 | Michalek . | |
| 5,699,986 | | 12/1997 | Welk . | |
| 5,735,492 | | 4/1998 | Pace . | |
| 5,794,172 | * | 8/1998 | Matheson et al. | 246/122 R |
| 5,809,448 | * | 9/1998 | Gimenez et al. | 246/122 R |
| 5,836,529 | * | 11/1998 | Gibbs | 246/122 R |
| 5,864,304 | * | 1/1999 | Gerszberg et al. | 340/903 |
| 5,890,682 | * | 4/1999 | Welk | 246/125 |
| 5,954,299 | * | 9/1999 | Pace | 246/293 |
| 5,978,718 | * | 11/1999 | Kull | 340/937 |

FOREIGN PATENT DOCUMENTS

| | | |
|---|---|---|
| 4331431C1 | 3/1995 | (DE) . |
| 0433768A2 | 6/1991 | (EP) . |
| 0761523A2 | 3/1997 | (EP) . |
| 07228254A | 8/1995 | (JP) . |
| 11020702A | 1/1999 | (JP) . |
| WO9635197A | 11/1996 | (WO) . |
| WO9909429A | 2/1999 | (WO) . |

* cited by examiner

*Primary Examiner*—Mark T. Le
(74) *Attorney, Agent, or Firm*—Shawn Hunter Felsman, Bradley, Vaden, Gunter & Dillon, L.L.P.

(57) ABSTRACT

An intelligent intersection control system features an internal controller that receives digital messages containing detailed information items concerning, for example, the direction, speed, length and identity of a train. The controller generates appropriate commands that coordinate the functions of crossing safety devices. A controller is capable of receiving and using much more detailed train information than is possible with conventional warning systems. Railroad crossing warning features are capable of responding more flexibly to this more detailed train information. The controller also continuously adjusts the activation state for safety devices associated with the crossing. In particular embodiments, the control system provides and displays crossing status information including the amount of time remaining until a crossing is cleared of train traffic, the approach of a second train during blocking of the crossing by a first train, or a suggested alternate route for waiting road vehicles. The controller may also be used to actuate numerous standard crossing warning features, including crossing blocking arms, flashing lights, warning chimes and warning horns.

21 Claims, 3 Drawing Sheets

INTELLIGENT RAIL CROSSING CONTROL SYSTEM AND TRAIN TRACKING SYSTEM

STATEMENT REGARDING FEDERALLY SPONSORED RESEARCH OR DEVELOPMENT

The U.S. Government has a paid-up license in this invention and the right in limited circumstances to require the patent owner to license others on reasonable terms.

CROSS-REFERENCE TO RELATED APPLICATIONS

Not Applicable.

BACKGROUND OF THE INVENTION

1. Field of the Invention

The present invention relates generally to systems and methods for the control of railroad crossing signals and devices. In other aspects, the invention relates to systems and methods for providing train location and travel information to remote locations and for tracking train traffic generally.

2. Description of the Related Art

Rail crossings, intersections where a railroad track crosses a roadway, have long presented a significant danger for vehicular traffic. Each year many car/train accidents occur at these locations.

There is a widespread belief that many such accidents result, directly or indirectly, from an inherent unreliability in the present "island circuit" arrangement used to actuate rail crossing safety devices. The island circuit system is an electromechanical system used to operate flashing crossing lights and crossing blocking arms. Functioning of this system is based upon the movement of a train into an "island circuit" which is located a short, predetermined distance around (i.e., on either side of) a railroad crossing. As the train passes over the island circuit, an electrical signal is generated indicative of the train's location within the "island" bounded by the predetermined distance. The signal is then transmitted along the track to a relay located near the railroad crossing. Upon receipt of the signal, the relay actuates flashing lights and lowers crossing blocking arms.

Unreliability in the island circuit system can cause rail crossing safety devices to be activated in error or even to fail to activate when necessary. Inadvertent activation occurs when salt, mud, water or other contaminants cause the island circuit system to shunt. It is believed by some that numerous such false alarms may lead to a conditioned disregard by some motorists of the crossing safety devices. On the other hand, the crossing devices can fail to activate due to contaminants, such as grease, that keep the train from completing the circuit. As a result, the signal indicating the presence of the train is not transmitted to the crossing.

Further, the warning time provided by island circuit systems is variable. Usually, the island circuit is configured so that safety devices adapted to govern vehicular traffic across a railway are activated when an approaching train is a certain distance from the rail crossing. These rail crossing safety devices include flashing lights and chimes as well as rail crossing blocking members or arms. Given the average speed of trains, this amount of time is on the order of twenty to thirty seconds warning before the train reaches the crossing and the crossing arms block the crossing. In actuality, however, trains may be either faster or slower than the planned average. Thus, the actual warning time varies based upon the actual speed of individual trains.

Some "constant warning time" systems are known which provide a predetermined amount of warning time regardless of the speed of an approaching train. These systems are complex electromechanical arrangements that measure the electrical resistance associated with passing trains and use the measurement to approximate the speed of the train. Variations in the train's speed are then compensated for so that, for a faster train, the safety devices at the crossing are activated earlier; for a slower train, the safety devices are activated slightly later.

A major drawback to both constant warning time systems and conventional island circuit systems is the expense associated with installing and maintaining these systems. Further, these arrangements provide only limited information to vehicle operators concerning the approaching train. Specifically, only the fact that a train is approaching the crossing is indicated.

A rail crossing collision avoidance system concept is discussed in U.S. Pat. No. 5,699,986 issued to Welk. This concept provides a general method whereby road vehicles in the vicinity of a rail crossing are informed of a train approaching the crossing. The patent discusses the use of data obtained from global positioning system (GPS) devices located on trains and/or at railroad crossings to provide such information. A processor/transmitter controller is located either on the train or at the train crossing itself to perform the calculations to determine train arrival times. If it is determined that an alarm condition exists, an alarm signal is transmitted to individual road vehicles which are equipped to receive it.

Another GPS-based rail crossing warning system is discussed in U.S. Pat. No. 5,554,982 issued to Shirkey et al. According to this patent, a GPS receiver is installed on top of a train and used to obtain information concerning the train's speed and position. This information is then transmitted to a rail crossing-based transceiver. When the train's estimated time of arrival at the crossing is within a predetermined range, the transceiver transmits the boundary coordinates of a warning zone. A road vehicle-based receiver receives the warning zone signal and the crossing's position. The receiver then determines the road vehicle's position and speed and produces an alarm to the road vehicle's operator when the vehicle is inside the warning zone and its distance to the crossing is within another predetermined range, which is a function of the road vehicle's speed.

The systems discussed in Welk and Shirkey et al. contain a number of disadvantages. First, they are useful to determine the position of only a single train in relation to a single railroad crossing. Thus, the system is not useful for deriving arrival time and train speed information for a number of different trains. Also, it is not possible to use them to derive information concerning the identity of individual trains. Further, centralized control and communications are not possible.

A system based upon the concepts discussed in the Welk and Shirkey et al. patents would also be expensive and perhaps impractical since specially-made receivers are needed in each individual road vehicle in order for the system to be fully operational. Because maintenance and upkeep of these receivers would undoubtedly be left to the discretion of the owners and operators of the individual road vehicles, the system might become unreliable.

In addition, it will be appreciated that the Welk and Sharkey et al. patents discuss only general concepts and do not reveal the structural and functional details of a controller which is capable of receiving a message and, in response thereto, controlling the safety features of a railroad crossing.

The present invention addresses the problems inherent in the prior art.

SUMMARY OF THE INVENTION

The present invention describes novel systems and methods for controlling rail crossings. An intelligent intersection control system is described featuring an internal controller which receives digital messages containing detailed information concerning, for example, the direction, speed, length and identity of a train. The controller of the present invention is considered "intelligent" in that it can provide contingent responses by rail crossing safety features based upon different inputs. The controller generates appropriate commands that coordinate the functions of crossing safety devices.

The system of the present invention provides a rail crossing controller capable of receiving and using much more detailed information concerning a train than is possible with conventional warning systems. The controller further continuously adjusts the activation state for safety devices associated with the crossing by changing them between an active safety device state, in which the devices are activated, and an inactive safety device state in which associated safety devices are inactivated. Rail crossing safety and warning features are thus capable of responding more flexibly to this detailed information. For example, in the case where a crossing has multiple tracks crossing a road, the crossing can provide a warning indicating that there are trains on each of the tracks.

In particular embodiments, the invention permits the control system to provide or display crossing status information including the amount of time remaining until a crossing is cleared of train traffic, the approach of a second train during the blocking of the crossing by a first train, or a suggested alternate route for waiting road vehicles. The control system may also actuate the crossing blocking arms so that the arms are lowered to block the intersection. Flashing lights, warning chimes and a warning horn may also be actuated and controlled by the control system.

In other aspects, the invention describes a system whereby the location, velocity, arrival times and identities of multiple trains can be determined.

In still other aspects, the present invention describes systems for generating and collecting detailed information concerning trains for remote access, by, for example, a traffic management center for a city. The information is then integrated into an overall traffic display for a city or otherwise used so that drivers can be warned about the location of trains, and traffic managers will be afforded better information concerning vehicle traffic bottlenecks. If necessary, road vehicle traffic and emergency vehicles can be rerouted in response to the detailed information.

Thus, the present invention comprises a combination of features and advantages which enable it to overcome various problems of prior devices. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENTS

Figure 1:
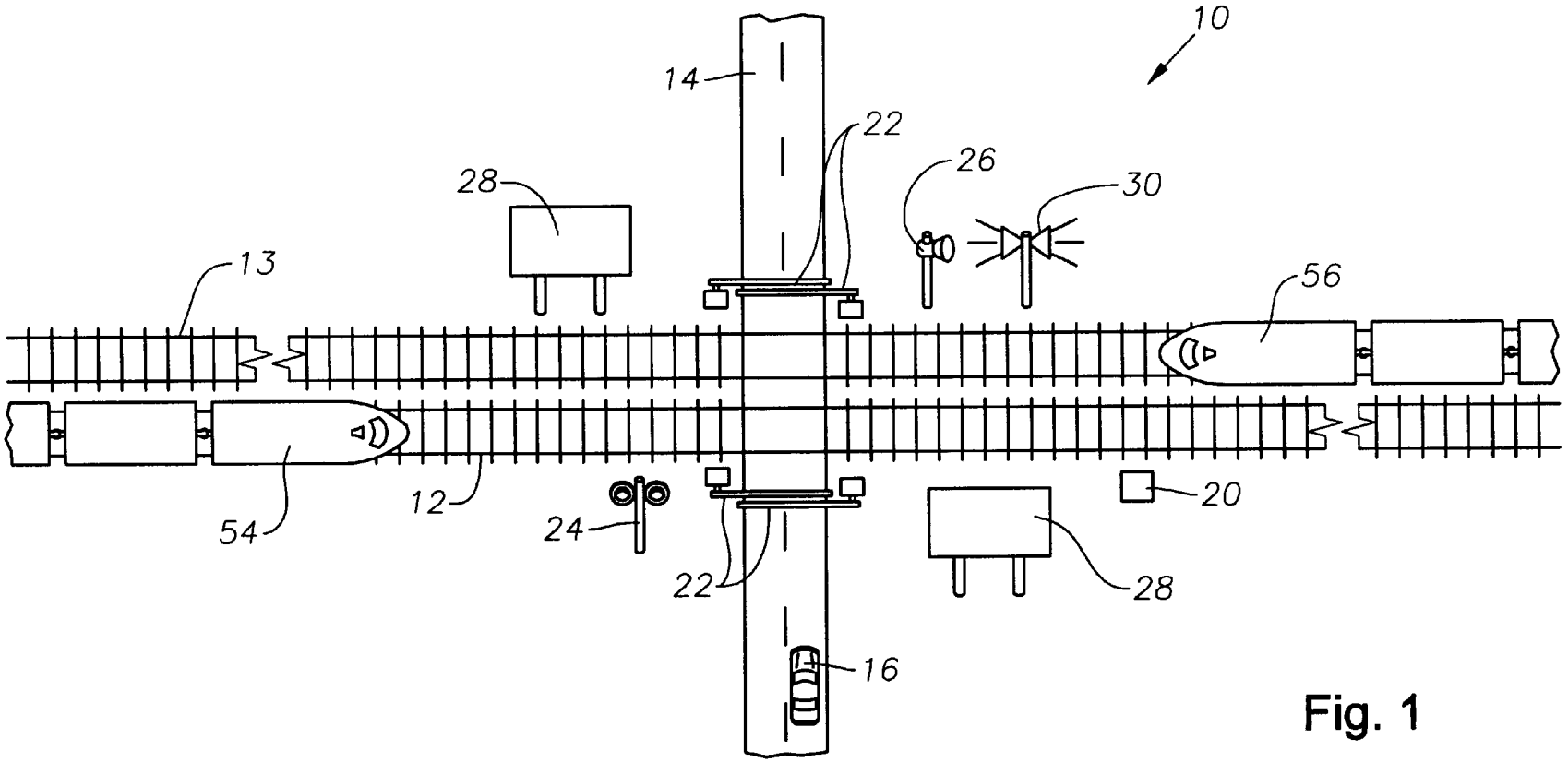
FIG. 1 is a sketch of an exemplary rail crossing with an approaching train.

Referring first to FIG. 1, an exemplary rail crossing 10 is shown which is formed by the intersection of two railways 12, 13 and a roadway 14. A road vehicle 16 is located on the roadway 14, approaching the rail crossing 10. A first train 54 is located on the first railway 12, approaching the rail crossing 10, and a second train 56 is located on the second railway 13, also approaching the rail crossing 10. The rail crossing 10 is provided with a protected housing 20 for a rail crossing controller which will be described in further detail shortly. A pair of gates or railroad crossing arms 22, of a type well known in the art, is located at the crossing 10. A set of flashing warning lights 24, and an air horn 26 are also located at the crossing 10. Additionally, alphanumeric display signs 28 are located at the intersection 10. Although not shown in FIG. 1, warning chimes of the type usually associated with rail crossings, are also located proximate the crossing 10. For clarity, wiring and the interconnection among these components are not shown.

Figure 2:
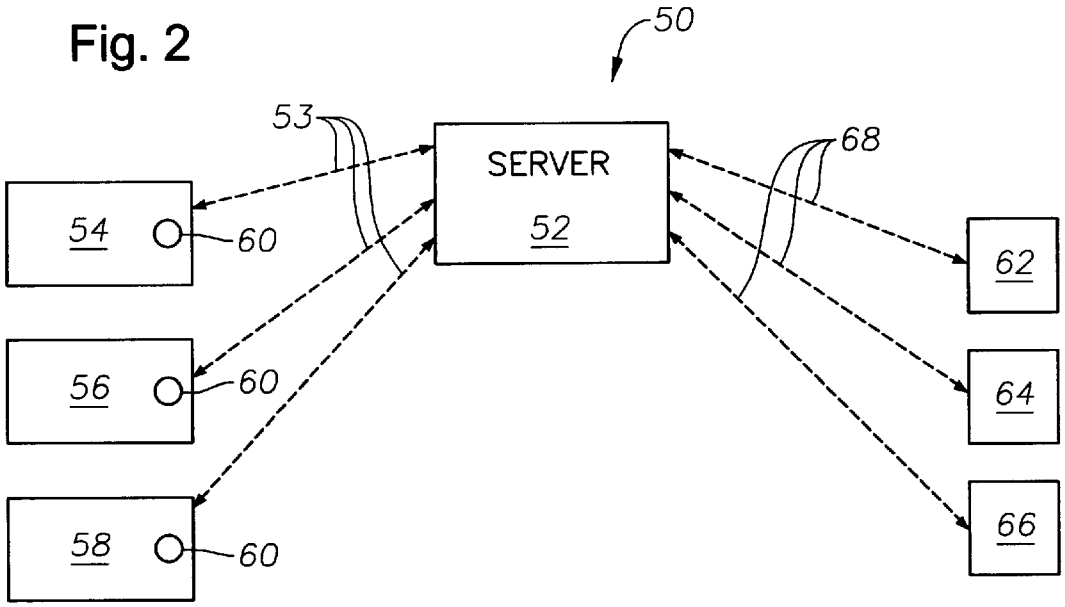
FIG. 2 is a block diagram depicting the operation of a server system which would provide a digital radio data message suitable for use with the present invention.

Referring now to FIG. 2, a block diagram is shown depicting the operation of an exemplary GPS-based server system 50 which provides centralized communications and data transfer between numerous trains and numerous rail crossing sites. Such a system is useful with respect to the present invention for providing digital messages used by the rail crossing controller and control system of the present invention, which will be described shortly. A suitable system of this type may be provided by a vendor of railroad safety equipment that provides communication-based train control systems. A server 52 is placed in a centralized location for the control of multiple rail crossings and multiple trains. Multiple trains 54, 56, 58 are shown as being in radio frequency (RF) communications with the server 52, as illustrated by the arrows 53. Thus, the server 52 and the trains 54, 56 and 58 are provided with RF transmitters and receivers (not shown). Although there may be any number of trains, only three are described here.

Each of the trains 54, 56 and 58 is assigned a discrete identification number. For clarity of explanation, these identification numbers will be 00001 for train 54, 00002 for train 56 and 00003 for train 58. Each of the trains 54, 56, and 58 is also provided with an on-board locator device 60 which uses a technology that provides a relative or global position for train location, preferably, a GPS receiver adapted to receive a location signal provided by an array of geostationary satellites. Such GPS receivers are known and commercially available and are capable of using the received signal to produce an absolute global position for the GPS receiver. The RF transmitter/receiver for each train transmits the received GPS location data and that train's identification number in a message to the server 52. This information is transmitted to the server 52 on a continuous basis so that, for example, the server 52 will receive periodic updated messages from each train.

The server 52 compares the locations of the trains to preprogrammed absolute global locations for rail crossings.

The server 52 then performs calculations to determine the speed of the train, the distance and times of arrival and departure for each train at each rail crossing.

The server 52 is also shown to be in RF communication with a plurality of receivers 62, 64 and 66, as illustrated by the arrows 68. The receivers 62, 64 and 66 are each located at rail crossings. Again, although there may be any number of rail crossings and rail crossing receivers, only three are described here. Each of the receivers 62, 64 and 66 is operationally associated with the control system and controller used for operation of crossing safety features, which will be described in greater detail shortly. The server 52 selectively provides digital messages to each of the receivers 62, 64 and 66 via the RF communication links. The server system 50 thus delivers accurate data via digital data radio messages at predetermined time intervals. The messages contain a string of train-related information items including, the train identification number, direction of travel, train speed, estimated times of arrival and departure at specified rail crossings, and the length of each train.

It should be understood that the specific construction and functioning of the devices depicted in the system 50 are not a part of the invention claimed. They are described generally for background information only and, thus, are not described in greater detail here. Other systems capable of providing a suitable data message could also be used.

Figure 3:
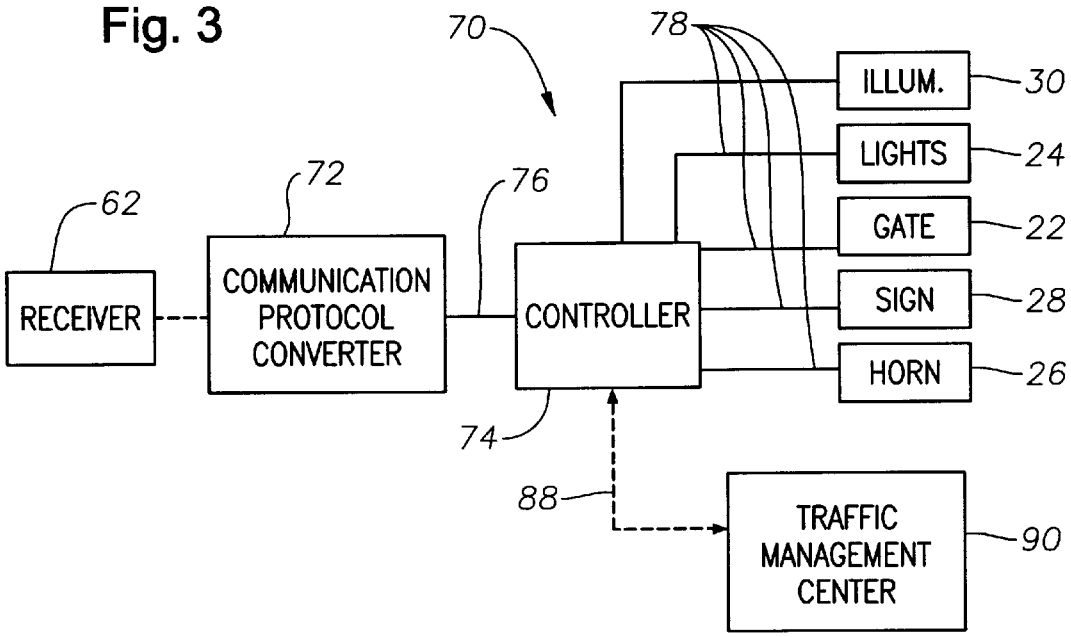
FIG. 3 is a schematic representation for components within an exemplary rail crossing control system, including the controller.

FIG. 3 is a schematic representation of a rail crossing control system 70 and associated safety devices controlled by the system 70. The control system 70 includes a communication protocol converter 72 that receives the signal from the receiver which, in this case, is receiver 62. The train control system vendor can provide a suitable communications protocol receiver. The communication protocol converter 72 functions to decode the signal obtained from the receiver 62 and format a digital message according to a predetermined data protocol that is provided by the vendor. The communication protocol converter 72 then provides the digital message to a controller 74 via a standard communications relay 76 such as an RS-232 network connection.

The controller 74 comprises a programmable logic controller of a type known in the art. Such a controller provides a processor and features a real time internal clock and a plurality of counters or timers, including an event timer, and one or more message timers. The controller 74 also includes a storage memory associated with the processor into which items of train related information may be stored.

The controller 74 receives the digital message and provides control commands via control relays 78 to individual rail crossing safety devices. The rail crossing safety devices include flashing lights 24, gate arms 22, an alphanumeric warning sign 28 and, optionally, a warning horn 26, all located proximate the rail crossing. It is currently preferred that the alphanumeric sign 28 present at least three lines of text, each of which can display at least 15 alphanumeric characters. It is preferred that the sign 28 also be capable of displaying text in a plurality of different colors.

Crossing illumination lighting 30 may also be included proximate the rail crossing which functions to illuminate the crossing using lighting when a train is approaching and present in the crossing. Such lighting may be used in addition to the other features, but is often used in very rural locations where crossing gate arms are not present. Warning chimes or bells (not shown) or other warning or safety devices may be included at the rail crossing 10 as well and associated with the controller 74 for controlled operation thereby.

In addition, the controller 74 is also in communication, as shown by arrow 88, with a traffic management center 90. Preferably, communication between the controller 74 and the traffic management center 90 is provided via a telephonic (modem) interconnection or RS-232 serial data link. However, the nature of the communication is not critical to the invention. As will be described, the communication interconnection permits an external, asynchronous computer located at the traffic management center 90 to obtain train-related information items and other information remotely from the controller 74.

The traffic management center 90 is typically operated by a city and is used to track and manage city vehicular traffic. One aspect of the management center's management function is to identify potential and actual traffic bottlenecks, including the passages of trains at rail crossings during peak traffic periods. When such bottlenecks occur, the management center can react by rerouting traffic as necessary. Because rail operations are largely unscheduled, the exact time of arrival for trains at rail crossings is not known. When the traffic management center 90 has real time information concerning the arrival of trains, it can more properly respond to such bottlenecks. Ambulances, fire trucks and other emergency vehicles can be dispatched around blocked crossings.

Several types of digital messages are received by controller 74, including a clock update message, a window message and a report message. Clock update messages include operating parameters governing operation of the controller, particularly the current time. Upon receiving an update message, the controller 74 initializes its operating parameters and resets its internal clock according to the values provided in the update message.

Window messages include the identification numbers of trains within a time or distance "window" of the rail crossing. For example, a window message might provide the identification numbers of all trains that have an ETA of three minutes or less for occupying the rail crossing 10. The controller 74 uses the window message to generate a train table which is a memory database containing an array of records for each such train. The records stored in the train table include the train identification number as well as the ETA and ETD for each such train.

Upon receipt of each report message from the communications protocol converter 72, the controller 74 reads the train identification number, and information items providing train direction, estimated time of arrival, estimated time of departure, speed, train length and location as determined by the train's GPS receiver 60 and server 52. It then stores the information items within the train table which is periodically refreshed with new information items provided by succeeding periodic report messages. The controller 74 also compares the values of information items to a current time clock to determine whether an active safety device state or "alarm" condition exists. If so, appropriate safety devices are actuated by the controller 74. The controller 74 also stores selected train-related information items into an IO data base for remote access by a traffic management center 90 or other suitable entity.

Figure 4:
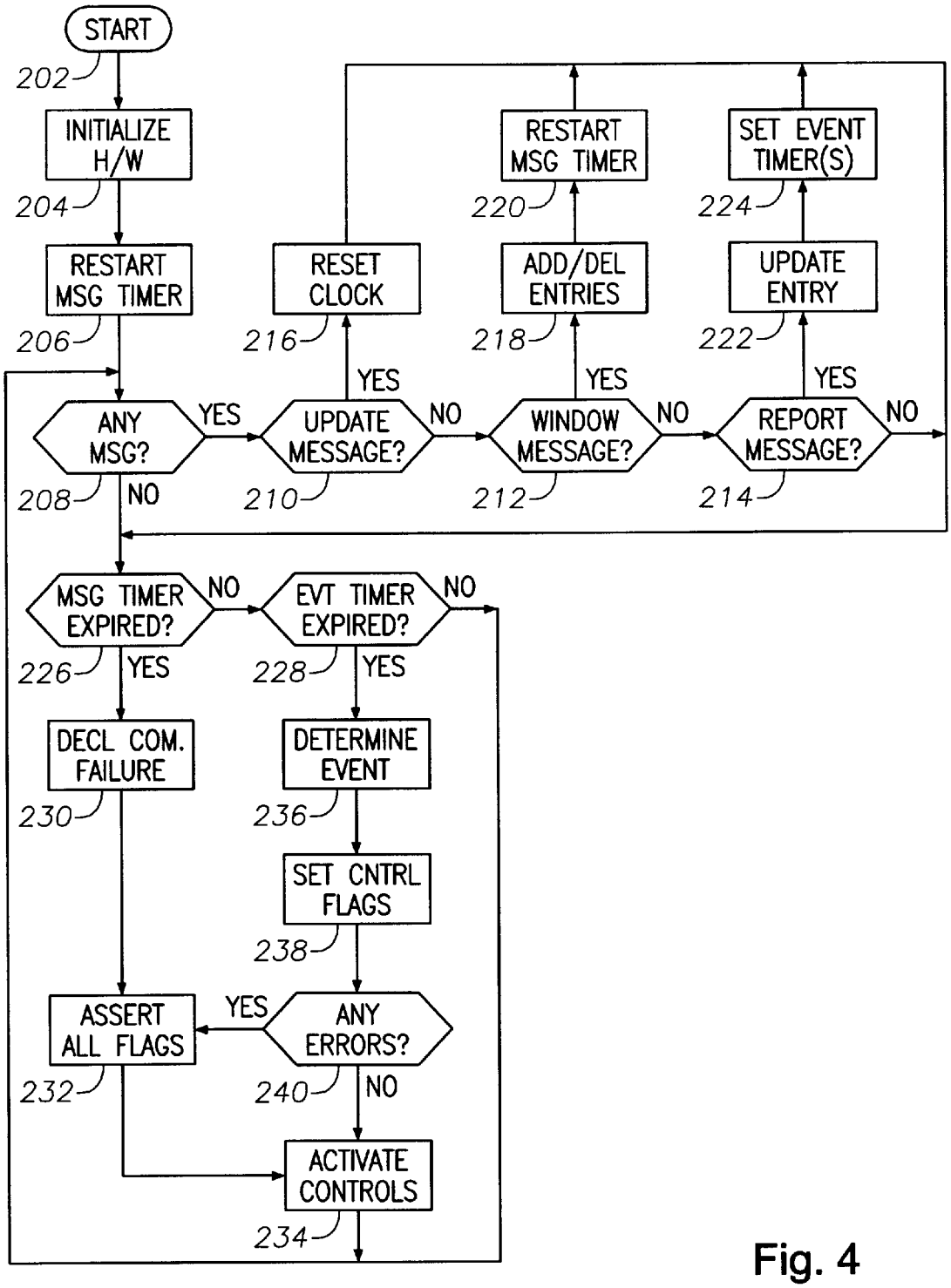
FIG. 4 is a flow diagram depicting major operations performed by one embodiment of the controller 74.

Referring now to FIG. 4, a flow diagram is depicted illustrating the major tasks performed in an exemplary routine for obtaining the digital messages provided by the server 52 and for determining whether to actuate safety devices associated with the controller 74. The flow diagram also illustrates operations performed by the controller 74 to prepare a message for transmission to a remote location, such as to the traffic management center 90. Upon powering up (block 202), the controller 74 begins by performing initialization tasks (204) such as setting the protocols and initializing communication ports, global variables, input/output ports and interrupt handlers. Timers are also initialized, as block 206 depicts.

Next, as shown by block 208 in FIG. 4, the controller 74 checks for messages in the incoming message queue. If the queue is not empty, controller 74 retrieves a message from the queue, determines the message type, and stores the information items from the message into a data array referred to as a train table. The controller 74 first tests (210) to see if the message is a clock update message, and if so, resets (216) the clock and updates any other mode registers for which the update message includes information items. If the message is not a clock update message, the controller tests (212) to see if the message is a window message, and if so, the controller 74 updates (218) a train table by adding rows for trains that the window message indicates have entered the window and removing rows for trains that the window message indicates have exited the window. After each window message is received, the controller 74 restarts (220) the message timer. If the message is not a window message, the controller 74 checks (214) to see if the message is a report message. If so, the controller 74 finds and updates (222) the row of the train table that corresponds to the train about which the report message is carrying information. In block 224, the controller 74 processes the train table to determine the next event(s) and to set one or more event timers accordingly.

After a message has been retrieved and processed, or after it has been determined that the message queue is empty, the controller 74 checks (226) the message timer to determine if it has expired. If so, then in block 230 the controller declares a communications failure. This implementation of a "dead man" switch causes the safety devices to be fully deployed in the event of a system error. In a preferred embodiment, the controller may wait to declare a communications failure until after the message timer has expired twice, i.e. after two consecutive expected window messages have been missed. After a communications failure is declared, the controller 74 asserts (232) all of the control flags for the safety devices and drives (234) the relays 78 in accordance with the control flags to deploy the safety devices for which flags are asserted.

If the message timer has not expired, the controller 74 checks (228) the event timer to determine if it has expired. If not, the controller returns to block 208 to retrieve another message from the message queue. If the event timer has expired, the controller 74 determines (236) which event has happened and sets (238) the control flags accordingly. A test (240) is made for any error events before the relays 78 are driven (234) in accordance with the control flags to establish an appropriate safety device state. When a train enters the time or distance proximity "window" for a rail crossing, safety device states are changed to activate the safety devices. When all trains depart such a window for a rail crossing, safety device states are changed to inactivate the safety devices.

If an error event is detected, all the control flags are asserted (232) before the relays 78 are driven (234). After driving (234) the relays 78, the controller 74 returns to block 208 to retrieve another message from the message queue.

In one embodiment, the timers are implemented by setting a "next event time", which could be, e.g., estimated time of arrival (ETA) and estimated time of departure (ETD) values. Then, at each timer check, the controller compares the event time with the known internal system time. If the system time is equal to or greater than the event time, an warning state is established and control flags are initialized for appropriate crossing warning devices, such as the lights 24, horn 26 and illumination 30.

In block 222, the controller 74 may also copy selected information items from the train table as well as device warning state information into a secondary database referred to as the IO database. The IO database is configured for remote access via modem or another communications interface by an external, asynchronous computer (not shown). Various known remote access means may be used. Examples of suitable remote access protocols include IEEE 488, TCP/IP and HDLC.

It is noted that error events can be generated in nearly any of the blocks in FIG. 4. For example, each time the train table is modified or processed, a check may be made against the clock and ETAs or ETDs in the train table to verify that the control flags are in the proper configuration. It is further noted that each of the safety devices may have a corresponding control flag so that the devices can be operated independently of each other. This provides a significant versatility for programming the sequence of operation of safety devices by the controller 74. For example, it may be desired at one rail crossing to activate all the safety systems 25 seconds before a train enters the crossing and deactivate all the safety systems immediately after the crossing has cleared. At another crossing, it may be desired to activate the flashing lights 120 seconds before the train enters the crossing, to activate the horn 30 seconds before the train enters the crossing, and to activate the gates 15 seconds before the train enters the crossing. These individual delay parameters may be provided in the update message, and the system is intelligent enough to adapt the operation of the systems as desired.

Also, it is noted that the controller 74 is versatile enough to handle new safety device configurations with (at most) minimal modification of the software. For example, a conventional traffic light at a nearby road intersection may be controlled by the described system. Messages for the alphanumeric display sign are easily programmed and modified remotely via the update message or possibly by a new message type. The software may be configured to "entertain" waiting motorists by displaying information about the trains moving through the crossing. Some of this information may be contained in the train table (e.g. length, speed, and identification number of the train), while other information may be provided from a local data base (e.g. origin, destination, tonnage, etc.) that could be generated by a new message type.

The controller 74 may activate and control the display upon the alphanumeric sign 28 a number of different ways. First, the controller 74 may compare the system time to the ETD for a particular train, say train 54, which is actively passing the rail crossing 10 so as to block road vehicle traffic across the crossing 10. The controller 74 then uses the ETD as an estimated amount of time for continued obstruction of the rail crossing 10 by the train 54. In the event that there are two trains, 54 and 56, passing the crossing 10, the latest ETD of the two trains is used for this estimate time. This time is then displayed upon the sign 28 using a predetermined, or preprogrammed, display format. For example, the sign 28 might display the message "CROSSING BLOCKED: TIME TO CLEAR—2 MINUTES."

In another exemplary embodiment for control of the sign 28, the sign 28 is made to display the fact that, while the crossing 10 is blocked by the passage of a first train 54, second train 56 is approaching to also block the intersection. The message can also be used to indicate to the road vehicle operator the direction from which the second train 56 is approaching the crossing 10. An exemplary message for this application might read as follows: "SECOND TRAIN APPROACHING FROM RIGHT."

In yet another exemplary embodiment for control of the sign 28, the controller 74 causes the sign 28 to display a message indicating a suggested alternate route (where available) for road vehicle drivers wishing to bypass the blocked crossing 10. If desired, this message may be displayed in an alternating, periodic sequence with a message indicating the remaining obstruction time for the crossing 10.

In conjunction with these messages, the controller 74 will also actuate the gate arms 22 so as to close the crossing 10 to vehicular traffic, flashing lights 24 and warning horn 26. It is noted that the display sign 28 is preferably a large sign that provides clearly visible messages and has illumination for operation at night or in low light.

The controller 74 provides a communication interface which permits a remote, asynchronous computer, such as one located at the traffic management center 90 to access the IO database within the controller 74 and obtain information items regarding all trains approaching the rail crossings within its jurisdiction. The communication interface may be provided by a modem or data cable capable of transmitting such data. The information items provided to the traffic management center 90 may include, for example, the identification number of each train, its location, speed, ETA and ETD to different crossings, and the lengths (number of cars) of each of the trains. In addition, the traffic management center 90 can obtain device state information for selected rail crossings so long as the train table or other storage memory associated with the controller 74 stores that information.

Through access of the controller 74 and the obtaining of selected train condition information from the IO database, the traffic management center 90 can construct a traffic overlay which indicates the current locations and movement details of all trains within a particular geographical area or jurisdiction for which the traffic management center 90 has responsibility. These train movement details preferably include the speed, direction of travel, ETA's and ETD's for each train with respect to each rail crossing within the jurisdiction of the traffic management center 90.

The devices and systems described herein can be used to completely replace the current track-based system used to control crossing safety features. However, it is presently preferred that they be used to augment existing systems, thereby providing a redundancy in intersection control which should reduce the amount of control failure.

While preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. Accordingly, the scope of protection is not limited to the embodiments described herein, but is only limited by the claims that follow, the scope of which shall include all equivalents of the subject matter of the claims.

What is claimed is:

1. A control system for a rail crossing safety device comprising:

a controller to receive a periodic messages from a single server at predetermined time intervals the messages containing train-related information and the controller operating a rail crossing safety system in response thereto; and a rail crossing safety system.

2. The control system of claim 1 wherein the rail crossing safety system comprises an alphanumeric display sign.

3. The control system of claim 1 wherein the rail crossing safety system comprises a rail crossing illumination device.

4. A method for controlling safety devices associated with a rail crossing, comprising:

a) providing periodic messages containing a plurality of train-related information items to a crossing-based controller from a single server;

b) determining a safety device state as a function of the train-related information items; and c) selectively operating a rail crossing safety device if a safety device state is established.

5. The method of claim 4 further comprising storing selected train-related information items in a data base for access by a remote, asynchronous computer.

6. A rail crossing safety system which comprises:

a) a rail crossing safety device configurable to govern vehicular traffic across a railway; and b) a control system coupled to control the safety device, the control system receiving periodic messages from a single server containing train-related information comprising train identification number, the control system further establishing safety device state in response to the periodic messages.

7. The rail crossing safety system of claim 6, wherein the rail crossing system has a location, wherein the periodic messages each indicate a current train position, and wherein the control system collects the train-related information from all messages having a current train position within a predetermined window around the location of the rail crossing safety system.

8. The rail crossing safety system of claim 7, wherein the control system is configured to generate a train table from collected train-related information, wherein each row corresponds to one unique train identification number, and wherein each row includes most recently collected information for a corresponding train identification number.

9. The rail crossing safety system of claim 7, wherein the train-related information within the periodic messages comprise an ETA and ETD for each train identification number.

10. The rail crossing safety system of claim 9, wherein the control system is configured to compare a current time value to an ETA and ETD and to establish a safety device state if the current time value is between the ETA and ETD for any train identification number.

11. The rail crossing safety system of claim 10, wherein the control system is configured to display a remaining crossing obstruction time on the safety device.

12. The rail crossing safety system of claim 11, wherein the safety device includes an alphanumeric display for displaying the remaining crossing obstruction time.

13. The rail crossing safety system of claim 10, wherein the safety device includes warning lights that flash in the safety device active state, and a warning bell that rings in the safety device active state.

14. The rail crossing safety system of claim 10, wherein the safety device includes blocking members which move into a traffic-blocking position in the safety device active state.

15. The rail crossing safety system of claim 6, wherein the control system is coupled to a traffic management system and configured to transmit safety device status information, wherein the traffic management system is configured to identify open and blocked traffic routes.

16. A control system for governing traffic across a railway at a rail crossing, wherein the control system comprises:

a receiver to receive from a single server periodic train-information messages each having a train-identification number;

a control interface to control a rail crossing device nd configurable to activate the rail crossing safety device in a safety device active state; and a processor coupled to the receiver to receive the periodic train-information messages and coupled to the control interface to control the rail crossing safety device in response to the train-information messages.

17. The control system of claim 16, wherein the periodic train-information messages each specify a current train position, and wherein the processor is configured to accept the train-related information from all periodic train-related information messages having a current train position within a predetermined window around the rail crossing.

18. The control system of claim 16, further comprising:

a memory coupled to the processor, wherein the periodic messages each specify a current train position, and wherein the processor is configured to store in memory information from a most recent train information message for each unique train identification number if the message specifies a current train position within a predetermined range around the rail crossing.

19. The control system of claim 17, wherein the periodic train-information messages each indicate a current train speed, direction and train length, and wherein the processor is configured to determine an ETA and ETD for each received train-information message.

20. The control system of claim 19, wherein the processor is configured to compare a current time value to the ETA and ETD, and wherein the processor is configured to place the control interface is a safety device active state if the current time value is greater than the ETA and less than an ETD for an accepted train-identification message.

21. The control system of claim 20, wherein the processor is configured to display a remaining crossing obstruction time on the rail crossing safety device.

* * * * *